US008986023B2

(12) United States Patent
Lee et al.

(10) Patent No.: US 8,986,023 B2
(45) Date of Patent: Mar. 24, 2015

(54) SLIM TYPE ELECTRONIC CONNECTOR AND ELECTRONIC DEVICE HAVING THE SAME

(71) Applicant: Wistron Corp., New Taipei (TW)

(72) Inventors: Wei-Yi Lee, New Taipei (TW); Tien-Chung Tseng, New Taipei (TW)

(73) Assignee: Wistron Corp., New Taipei (TW)

( * ) Notice: Subject to any disclaimer, the term of this patent is extended or adjusted under 35 U.S.C. 154(b) by 0 days.

(21) Appl. No.: 13/968,946

(22) Filed: Aug. 16, 2013

(65) Prior Publication Data

US 2014/0134859 A1 May 15, 2014

(30) Foreign Application Priority Data

Nov. 9, 2012 (TW) ..... 101141772 A

(51) Int. Cl.
*H01R 13/44* (2006.01)
*H01R 13/447* (2006.01)

(52) U.S. Cl.
CPC ..... *H01R 13/447* (2013.01)
USPC ..... 439/138; 439/144

(58) Field of Classification Search
USPC ..... 439/138, 144, 137, 142
See application file for complete search history.

(56) References Cited

U.S. PATENT DOCUMENTS

| | | | | |
|---|---|---|---|---|
| 6,971,921 | B1 * | 12/2005 | Lai | 439/676 |
| 7,850,371 | B2 * | 12/2010 | Riley et al. | 385/77 |
| 7,950,936 | B2 * | 5/2011 | Wang et al. | 439/144 |
| 8,337,222 | B2 * | 12/2012 | Hung et al. | 439/138 |
| 2010/0227486 | A1 * | 9/2010 | Lin et al. | 439/144 |
| 2013/0130523 | A1 | 5/2013 | Chen | |
| 2013/0130524 | A1 * | 5/2013 | Wang | 439/142 |
| 2013/0260581 | A1 * | 10/2013 | Kuo et al. | 439/138 |

FOREIGN PATENT DOCUMENTS

| | | |
|---|---|---|
| CN | 102983456 A | 3/2013 |
| TW | M418437 U1 | 12/2011 |
| TW | M422777 U1 | 2/2012 |
| TW | M430057 U1 | 2/2012 |

OTHER PUBLICATIONS

Taiwan Patent Office, Office action issued on Oct. 28, 2014.

* cited by examiner

*Primary Examiner* — Gary Paumen
(74) *Attorney, Agent, or Firm* — Li & Cai Intellectual Property (USA) Office

(57) ABSTRACT

A slim type electronic connector for receiving a plug therein includes a half socket, a covering lid, a holding seat, and a recovering element. The covering lid has a main body, a sheltering portion extended from the main body, and a pair of rotating axles formed at one end of the main body. An inserting space is formed between the half socket and the holding seat. When the covering lid rotates to a covered position, the sheltering portion extends beyond a front edge of the holding seat. When the covering lid rotates to an opening position, the sheltering portion moves away the front edge of the holding seat to allow for inserting the plug. When the plug is inserted between the half socket and the holding seat, the recovering element pushes the sheltering portion to engage the plug for preventing from moving outside.

20 Claims, 17 Drawing Sheets

SLIM TYPE ELECTRONIC CONNECTOR AND ELECTRONIC DEVICE HAVING THE SAME

BACKGROUND

1. Field of the Disclosure

The present disclosure relates to a slim type electronic connector and an electronic device having the same; in particular, to a slim type electronic connector applicable on a slim type electronic device having a cover which can rotate to reduce the overall height when not in use.

2. Description of Related Art

With the advancement of electronic technology, electronic devices such as ultrabooks and their casings are becoming increasingly slimmer. Common electronic connectors of input and output ports installed on electronic devices need to be designed with their thicknesses in mind. The thickness of a typical RJ45 communication socket, for example, is possibly larger than the thickness of the electronic device itself.

Common slim type electrical devices often omit communication sockets or employ adapters, which are inconvenient to use. Another known technique such as Patent US 2010/0248554A1, "CONNECTOR SOCKET AND PORTABLE ELECTRONIC DEVICE USING THE SAME," separates the top and bottom portions of the RJ45 communication socket and connects them pivotally. During testing such as plug and unplug tests, this structure usually shows a lack of structural strength. Since communication cables often sustain frequent plugging and tugging, the pivot structure between the top and bottom portions is easily fatigued.

Hence, the present inventor believes the above mentioned disadvantages can be overcome, and through devoted research combined with application of theory, finally proposes the present disclosure which has a reasonable design and effectively improves upon the above mentioned disadvantages.

SUMMARY OF THE DISCLOSURE

The object of the present disclosure is to provide a slim type electronic connector and an electronic device having the same, one face of which reduces the overall height of the electrical connector when not in use, and the other face of which increases the strength of the electrical connector in order to prevent fatigue created by frequent plugging and unplugging.

In order to achieve the aforementioned objects, according to an embodiment of the present disclosure, a slim type electrical connector is provided for accommodating a plug within, comprises a half socket, a covering lid, a holding seat disposed between the half socket and the covering lid, and a recovering element. The half socket has multiple endpoints. The covering lid has a main body, a sheltering portion extended from the main body, and at least one rotating axle formed at one end of the main body and pivoted on an electronic device case. An inserting space is formed between the half socket and the holding seat. When the covering lid rotates along the rotating axles to a covered position, the sheltering portion of the covering lid extends beyond a front edge of the holding seat. When the covering lid rotates along the rotating axles to an opening position, the sheltering portion moves away from the front edge of the holding seat to expose the inserting space. The recovering element applies a force on the sheltering portion of the covering lid to press against the holding seat. When the plug is inserted between the half socket and the holding seat, the recovering element pushes the sheltering portion to engage the plug for preventing from moving outside.

In order to achieve the aforementioned objects, the present disclosure also provides an electronic device having a slim type electronic connector. The electronic device includes an upper case, a lower case, and a slim type electronic connector. The lower case has an entrance portion for a plug to be inserted into, and at least one pivot seat. The slim type electrical connector includes a half socket positioned under the upper case and having multiple endpoints disposed thereon; a covering lid which has a main body, a sheltering portion extended from the main body for sheltering the entrance portion, and at least one rotating axle formed at one end of the main body; at least one rotating axle which is pivotally disposed on at least one corresponding pivot seat; a holding seat which is disposed between the half socket and the covering lid, wherein an inserting space for accommodating plugs is formed between the half socket and the holding seat, and the sheltering portion extends beyond the front edge of the holding seat; and a recovering element provides a force on the sheltering portion of the covering lid to press against the holding seat. When the plug is inserted between the half socket and the holding seat, the recovering element pushes the sheltering portion to engage the plug for preventing from moving outside.

The present disclosure has the following advantages: the covering lid of the present disclosure rotates along the rotating axles to a covered position to reduce its height, or an opening position to allow for inserting the plug, thereby reducing the overall height of the electronic connector. Additionally, the holding seat is fixed to the electronic device case, and covers the pivot structure of the covering lid, thereby increasing the structural strength.

In order to further the understanding regarding the present disclosure, the following embodiments are provided along with illustrations to facilitate the disclosure of the present disclosure but are not intended to define the present disclosure.

DETAILED DESCRIPTION OF THE PREFERRED EMBODIMENTS

The aforementioned illustrations and following detailed descriptions are exemplary for the purpose of further explaining the scope of the present disclosure. Other objectives and advantages related to the present disclosure will be illustrated in the subsequent descriptions and appended drawings.

First Embodiment

Figure 1:
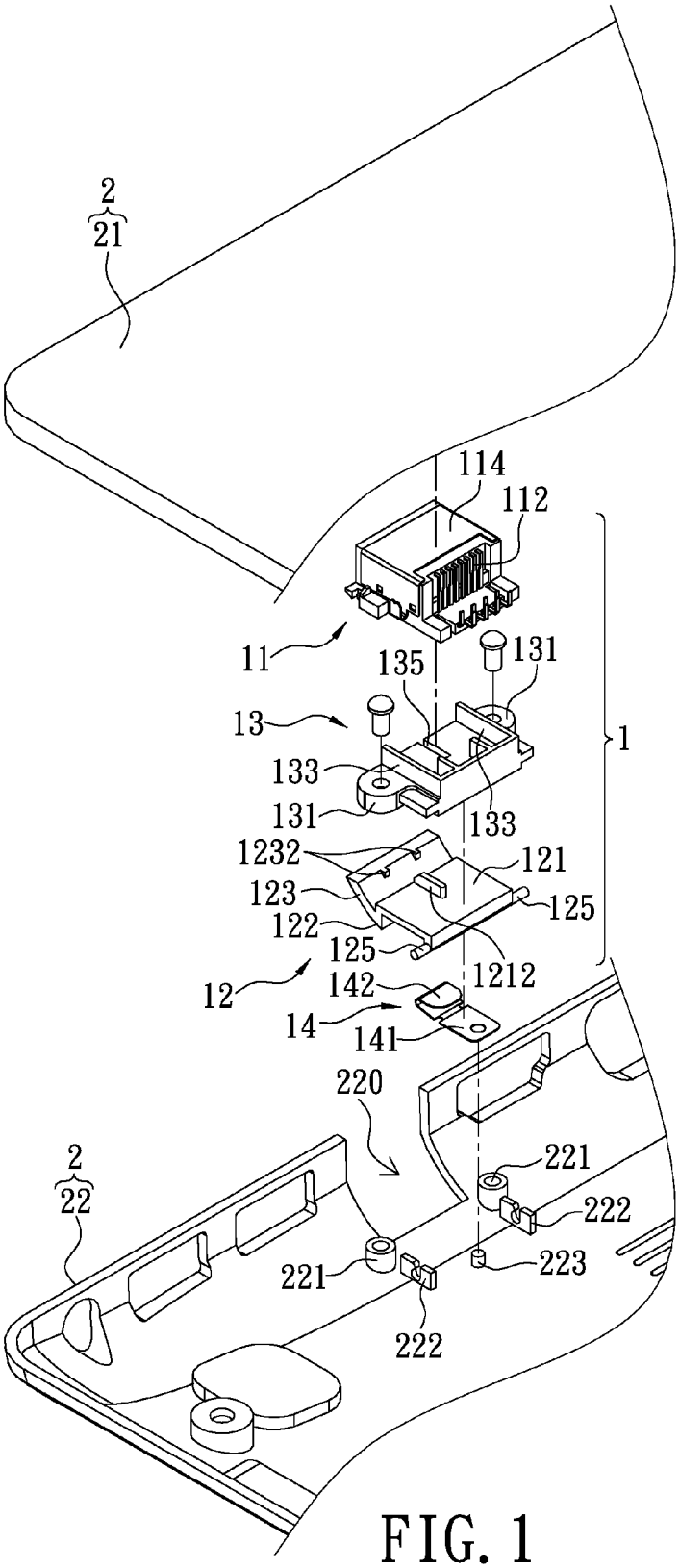
FIG. 1 shows a perspective exploded diagram of a first embodiment of a slim type electronic connector and an electronic device case of the present disclosure.
Figure 2:
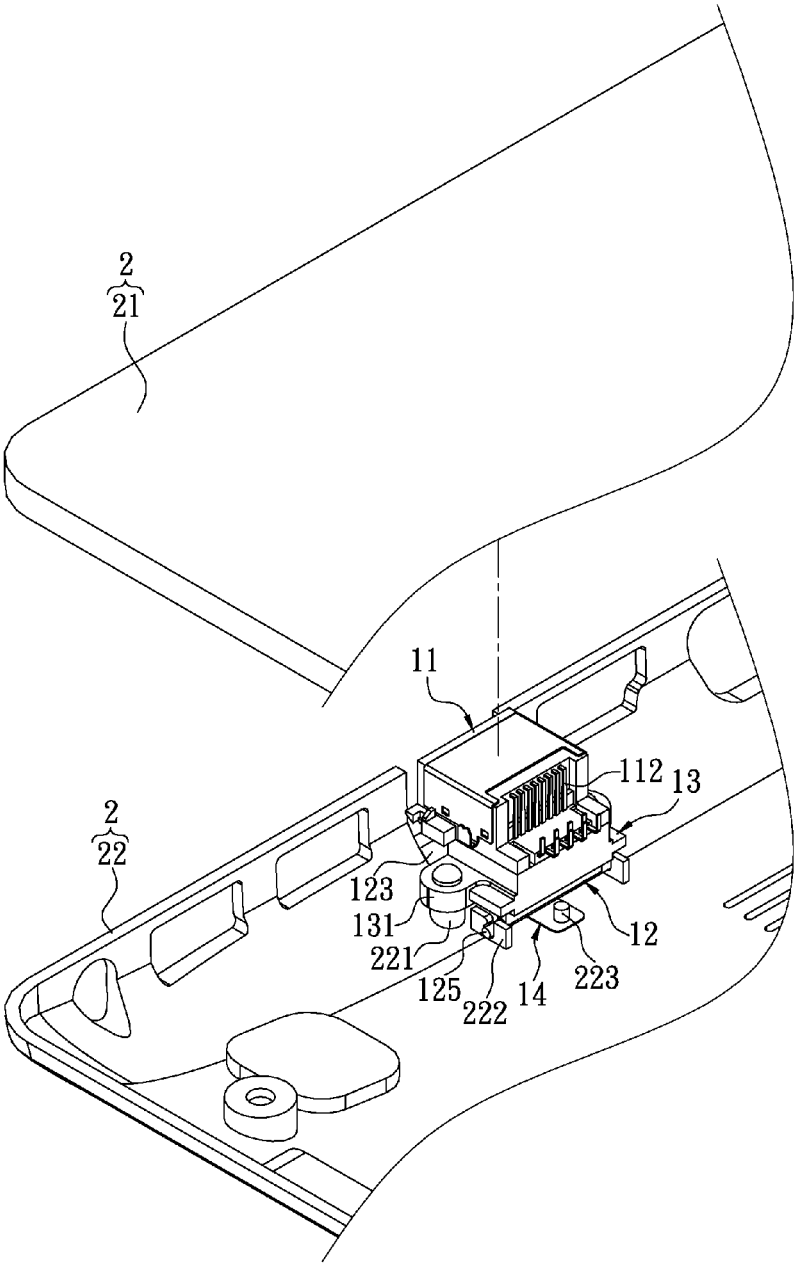
FIG. 2 shows a perspective assembly diagram of the slim type electronic connector of FIG. 1.
Figure 3:
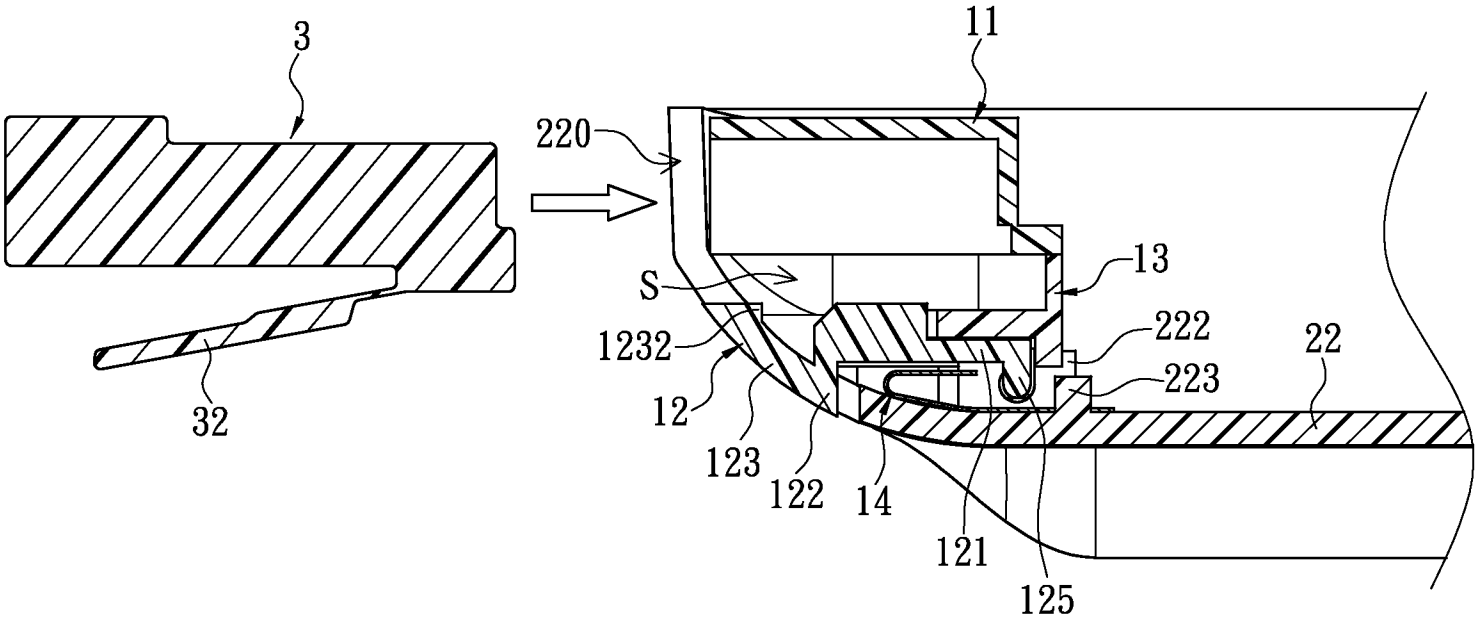
FIG. 3 shows a cross sectional diagram of the slim type electronic connector of FIG. 2 and an unplugged plug.

FIG. 1 and FIG. 2 are respectively a perspective exploded diagram and a perspective assembly diagram of a slim type electronic connector and an electronic device case of the present disclosure. The present disclosure provides a slim type electronic connector 1 and an electronic device having the same. A portion of a case 2, for example a case for a laptop, super slim type laptop, etc, embodies the electronic device of the present embodiment. An RJ-45 communication socket embodies the slim type electronic connector 1 of the present embodiment. However the choice of electronic connector of the present disclosure is not limited thereto. The slim type electronic connector 1 is disposed on the electronic device case 2 to accommodate an RJ-45 plug 3 (as shown in FIG. 3). The electronic device case 2 can be divided into an upper case 21 and a lower case 22. In the present embodiment, the slim type electronic connector 1 is mainly disposed on the lower case 22. The lower case 22 forms an entrance portion 220. The slim type electronic connector 1 faces the entrance portion 220. The plug 3 is inserted into the slim type electronic connector 1 through the entrance portion 220 of the electronic device case 2.

The slim type electronic connector 1 of the present disclosure includes a half socket 11, a covering lid 12, a holding seat 13 disposed between the half socket 11 and the covering lid 12, and a recovering element 14 for applying a force on the covering lid 12 to press against the holding seat 13. Each component is described in detail in the following.

The half socket 11 has multiple endpoints 112 to be electrically connected to the plug 3. The endpoints 112 extend from the inside of the half socket 11 to the outer side on the back end of the half socket 11. The interior space of the half socket 11 corresponds to the contour of the plug 3. The half socket 11 of the present embodiment further has a metal cover 114 disposed at its top surface for providing electromagnetic shielding.

The covering lid 12 has a main body 121, a sheltering portion 123 extended from the main body 121, and a pair of rotating axles 125 formed at one end of the main body 121. The present embodiment has two rotating axles 125. The two rotating axles 125 are positioned at one end of the main body 121 further away from the sheltering portion 123 and respectively extend outward from the two sides of the main body 121. However the present disclosure is not limited thereto. For example the rotating axle can amount to one and be disposed in the middle of the edge of the main body 121. The pair of rotating axles 125 is pivotally disposed on the electronic device case 2, namely the lower case 22. Corresponding to the pair of rotating axles 125, the lower case 22 has a pair of pivot seats 222. The pair of rotating axles 125 is disposed on the pair of pivot seats 222. This configuration allows the covering lid 12 to pivot about the rotating axles 125, and be movably positioned at an opening position and a covered position. When the covering lid 12 is at the covered position, the overall height is relatively smaller than that of a typical RJ-45 communication socket. The covering lid 12 needs to move downward to the opening position only when a plug is to be inserted.

The present embodiment has a gap of definite height between the main body 121 and the lower case 22. The outer edge of the main body 121 is close to the bottom edge of the entrance portion 220 and extends downwards to form a turning portion 122. The sheltering portion 123 extends slantingly upwards from the turning portion 122. The sheltering portion 123 partially shelters the entrance portion 220 of the lower case 22, ideally conforming to the shape of the lower case 22. The side of the sheltering portion 123 facing the lower case 22 extends in an arc shape corresponding to the contour of the lower case 22. Two retaining blocks 1232 protrude on the interior side of the sheltering portion 123 toward the holding seat 13, for retaining the plug 3 from detaching. When the plug 3 is inserted between the half socket 11 and the holding seat 13, the retaining blocks 1232 of the sheltering portion 123 engage the plug 3 to prevent it from moving outwards.

The holding seat 13 is disposed between the half socket 11 and the covering lid 12. A front end inserting space is formed for accommodating the plug 3 between the half socket 11 and the holding seat 13. The holding seat 13 abuts the half socket 11. The length of the half socket 11 is larger than the length of the holding seat 13. In other words, the holding seat 13 of the present embodiment is shorter than the typical RJ-45 socket. As shown in FIG. 3, from a lateral view, the half socket 11 and the front end of the holding seat 13 form a stair-shaped space S, corresponding to the arc shape of the lower case 22. The sheltering portion 123 extends beyond the front edge of the holding seat 13 and faces the stair-shaped space S.

In the present embodiment, the position of the holding seat 13 corresponds to the main body 121. The two sides of the holding seat 13 each have a fixing portion 131. The fixing portions 131 are fixed to the electronic device case 2, for example fixed to the column 221 of the lower case 22 by screws or hot melting. The holding seat 13 has multiple lateral walls 133 facing the half socket 11 for guiding the plug 3. The holding seat 13 forms a through groove 135. The main body 121 forms a guiding plate 1212 facing towards the holding seat 13. The guiding plate 1212 is movably disposed in the through groove 135. By this configuration, the holding seat 13 of the present disclosure is securely fixed to the lower case 22, in contrast to the typical method of pivotally connecting to the upper case, thereby increasing the structural strength of the present disclosure. Additionally, the holding seat 13 covers the pivot seat 222, in order to increase the structural strength of the pivot seat 222. This configuration prevents the pivot structure of the covering lid 12 from being damaged due to frequent tugging of the communication wires, thereby protecting the covering lid 12 positioned below. In general, the present disclosure can endure demanding tests.

The recovering element 14 is used to apply a force on the sheltering portion 123 of the covering lid 12 to press against the holding seat 13. The recovering element 14 can use a spring force, a magnetic force, etc to accomplish its purpose. The recovering element 14 of the present embodiment is a spring plate disposed between the main body 121 and the electronic device case 2. In other words, the recovering element 14 is disposed at the top surface of the lower case 22 and abuts the lower face of the main body 121. The recovering element 14 has a fastening portion 141, and a curved portion 142 extending upwards and frontwards from the fastening plate 141 in a curve. A fastening rod 223 is disposed on the lower case 22 for fastening the fastening portion 141 of the recovering element 14, for example fastening the fastening portion 141 by screws or hot melting. The curved portion 142 provides the main body 121 an upward spring force.

Figure 4:
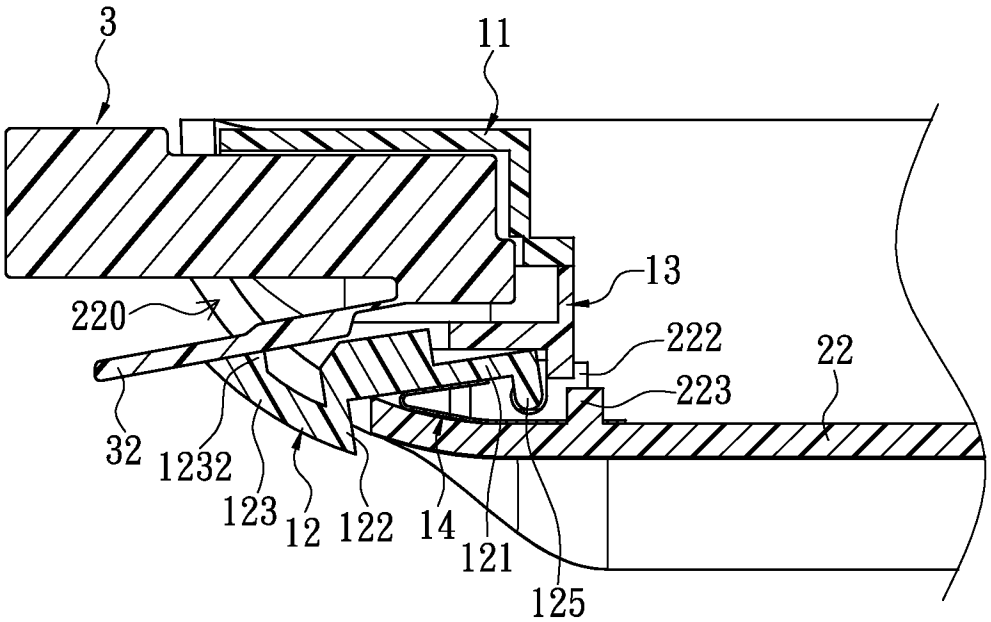
FIG. 4 shows a cross sectional diagram of the slim type electronic connector of FIG. 2 and a plugged plug.

FIG. 3 and FIG. 4 are respectively side view cross sectional diagrams of the first embodiment of the slim type electronic connector of the present disclosure before and after accommodating the plug. As shown in FIG. 3, when the covering lid 12 is at the covered position, namely when the external surface of the sheltering portion 123 is aligned with the external surface of the lower case 22, the turning portion 122 and the entrance portion 220 have a small gap between them. The sheltering portion 123 of the covering lid 12 is positioned at the arc-shaped portion of the lower case 22, thereby reducing the volume of the protruding portion.

When the plug 3 is to be plugged in, the covering lid 12 is turned such that the sheltering portion 123 moves further away from the input portion 220. At this moment, the main body 121 presses downward on the bottom edge of the entrance portion 220, and deforms the spring plate to conserve an upward spring force. As shown in FIG. 4, when the covering lid 12 is in an opening position, the sheltering portion 123 rotates outwards and moves away from the lower case 22 by some distance, and the turning portion 122 moves downward and abuts the bottom edge of the entrance portion 220. Thus, the plug 3 can be inserted into the slim type electronic connector 1. The outwardly turned sheltering portion 123 is forced by the spring force of the spring plate to press tightly upwards against the release arm 32 of the plug 3, in order to fix the plug 3 and prevent it from detaching.

As shown in FIG. 3 and FIG. 4, the present disclosure mainly spares the height used in a typical RJ-45 socket to retain the release arm 32 of the RJ-45 plug 3. In a normal state, the covering lid 12 covers the entrance portion 220 of the electronic case 2 to reduce overall height. When necessary, the covering lid 12 is opened to allow for inserting the plug 3, and provides the effect of fixing the plug 3.

Second Embodiment

Figure 5:
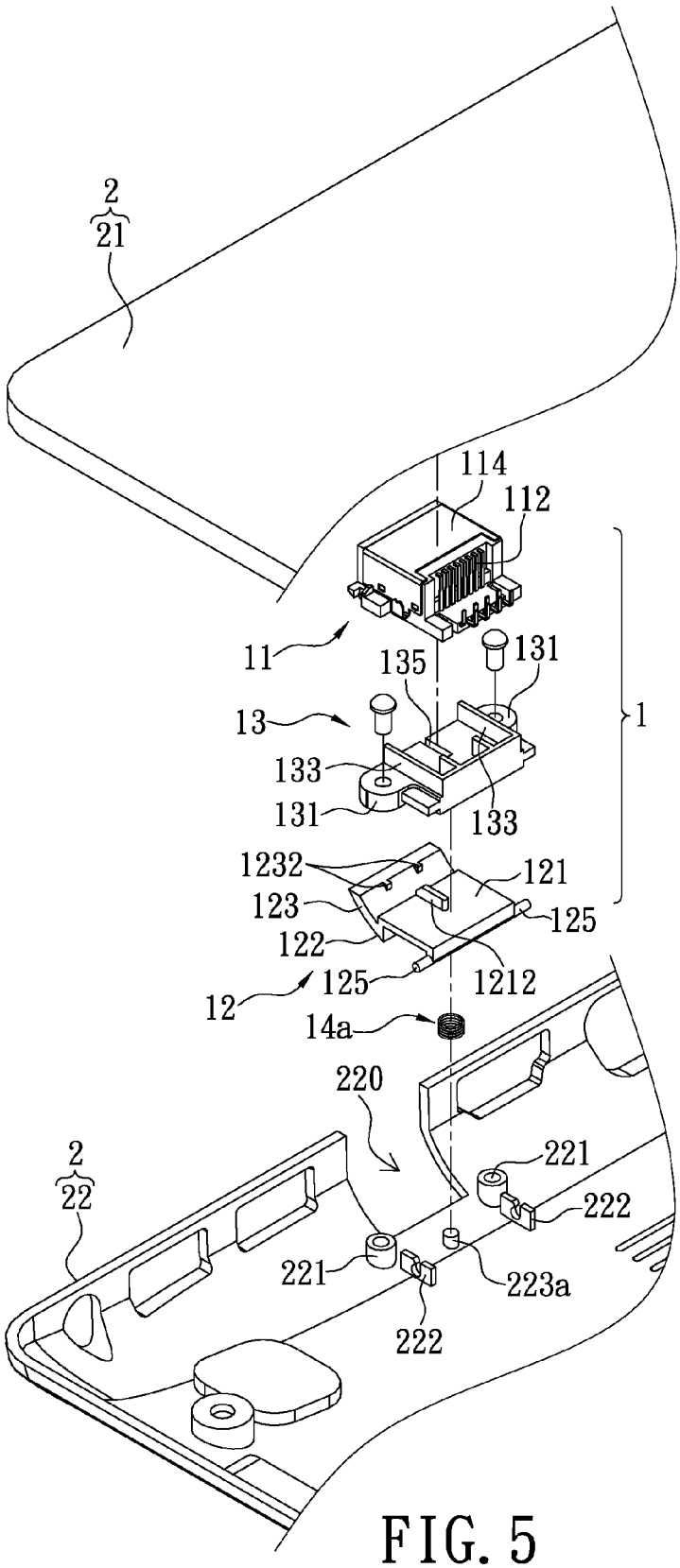
FIG. 5 shows a perspective exploded diagram of a second embodiment of a slim type electronic connector and an electronic device case of the present disclosure.

FIG. 5 is a perspective exploded diagram of a second embodiment of a slim type electronic connector and an electronic device case of the present disclosure. The present embodiment differs from the first embodiment in that the recovering element 14*a* is a coil spring disposed between the main body 121 and the electronic device case 2, namely between the lower case 22 and the main body 121. Similar to the first embodiment, a fastening rod 223*a* is disposed on the lower case 22 for the coil spring to be disposed onto. The fastening rod 223*a* is positioned beneath the main body 121. The height of the fastening rod 223*a* is slightly smaller than the height of the coil spring when compressed by the main body 121.

Figure 6:
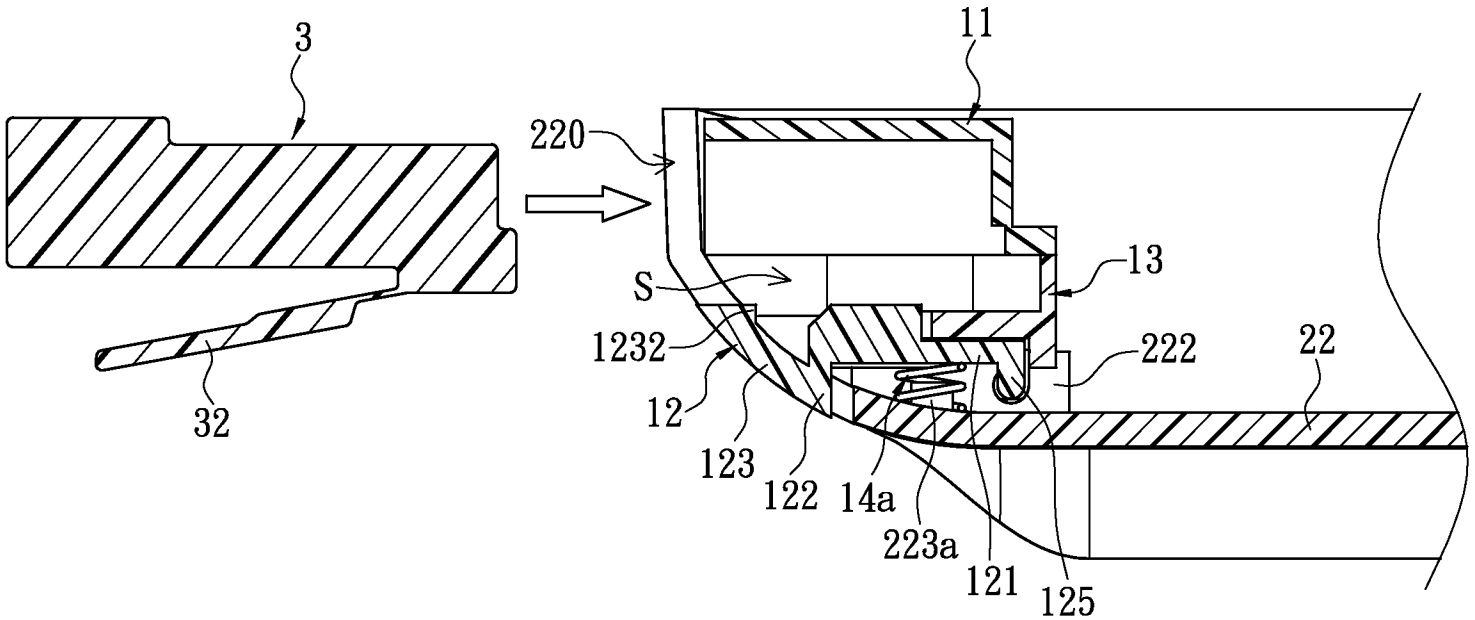
FIG. 6 shows a cross sectional diagram of the slim type electronic connector of FIG. 5 and an unplugged plug.
Figure 7:
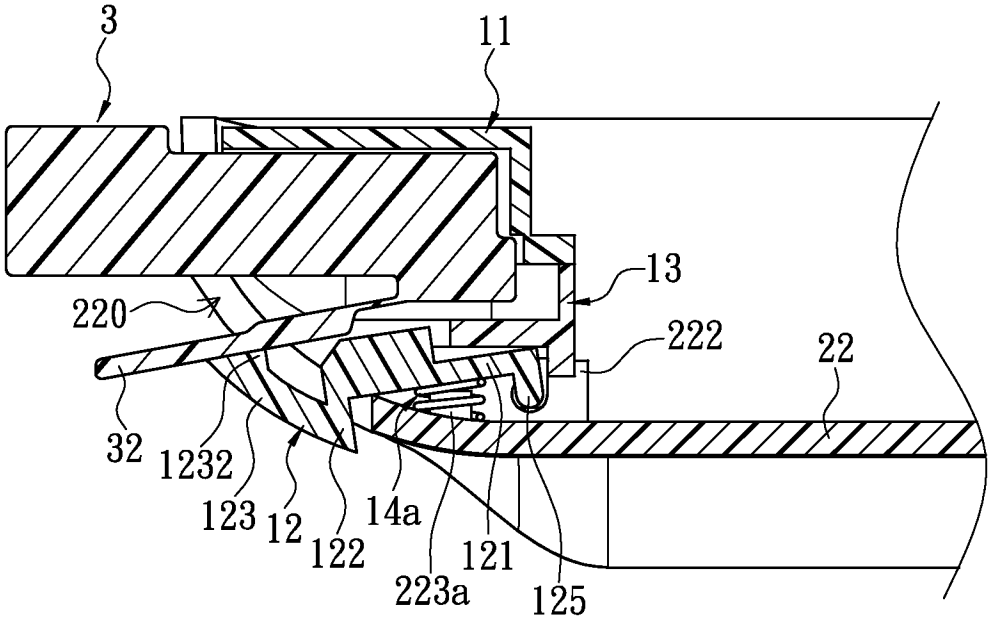
FIG. 7 shows a cross sectional diagram of the slim type electronic connector of FIG. 5 and a plugged plug.

FIG. 6 and FIG. 7 are respectively side view cross sectional diagrams of the second embodiment of the slim type electronic connector of the present disclosure before and after accommodating the plug. When the covering lid 12 is open, the plug 3 can be inserted into the present disclosure, the main body 121 presses downward against the coil spring, and the coil spring stores a spring force. Similar to the first embodiment, when the plug 3 is inserted into the slim type electronic connector 1, the sheltering portion 123 is forced by the spring force of the coil spring to press tightly upwards against the release arm 32 of the plug 3, in order to fix the plug 3 and prevent it from detaching.

Third Embodiment

Figure 8:
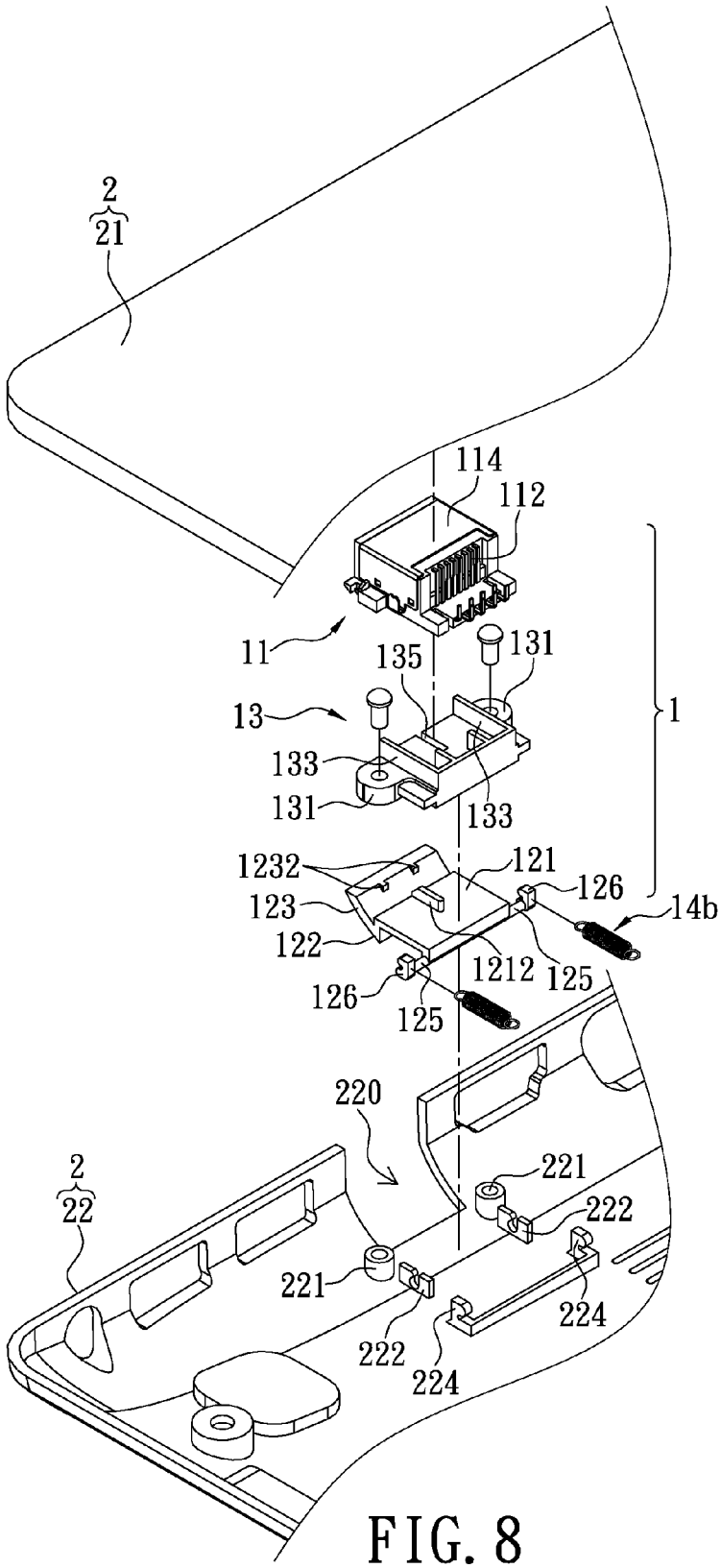
FIG. 8 shows a perspective exploded diagram of a third embodiment of a slim type electronic connector and an electronic device case of the present disclosure.
Figure 9:
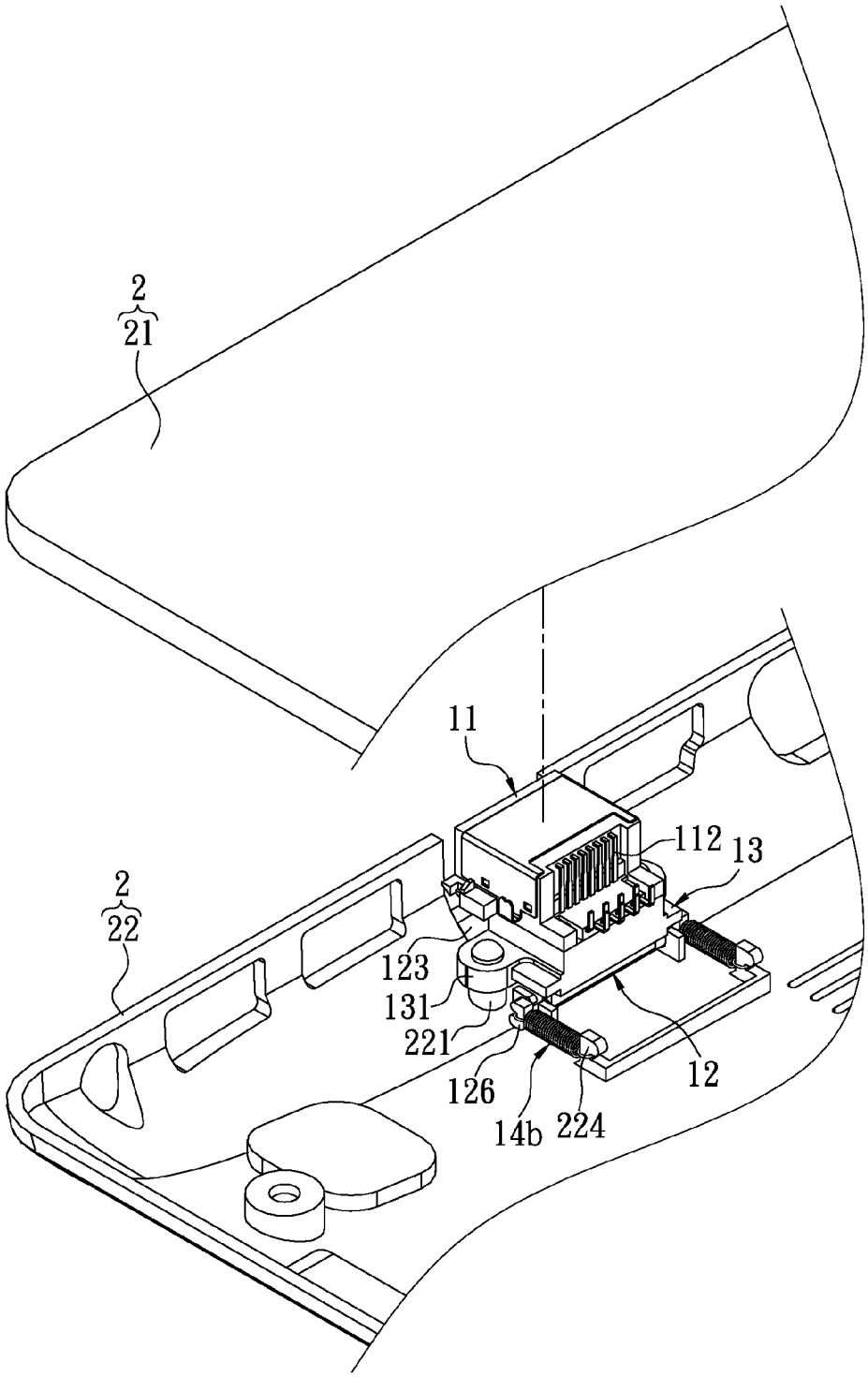
FIG. 9 shows a perspective assembly diagram of the slim type electronic connector of FIG. 8.

FIG. 8 and FIG. 9 are respectively a perspective exploded diagram and a perspective assembly diagram of a third embodiment of a slim type electronic connector and an electronic device case of the present disclosure. The present embodiment differs from the first embodiment in that the recovering element 14*b* of the present embodiment is a stretch spring. A hook portion 126 protrudes from each of the two rotating axles 125 toward the holding seat 13. One end of the stretch spring is connected to the hook portion 126, while the other end is fixed to the electronic device case 2. A pair of fixing hooks 224 is disposed behind the covering lid 12 on the lower case 22 of the present embodiment for hooking onto the stretch spring.

Figure 10:
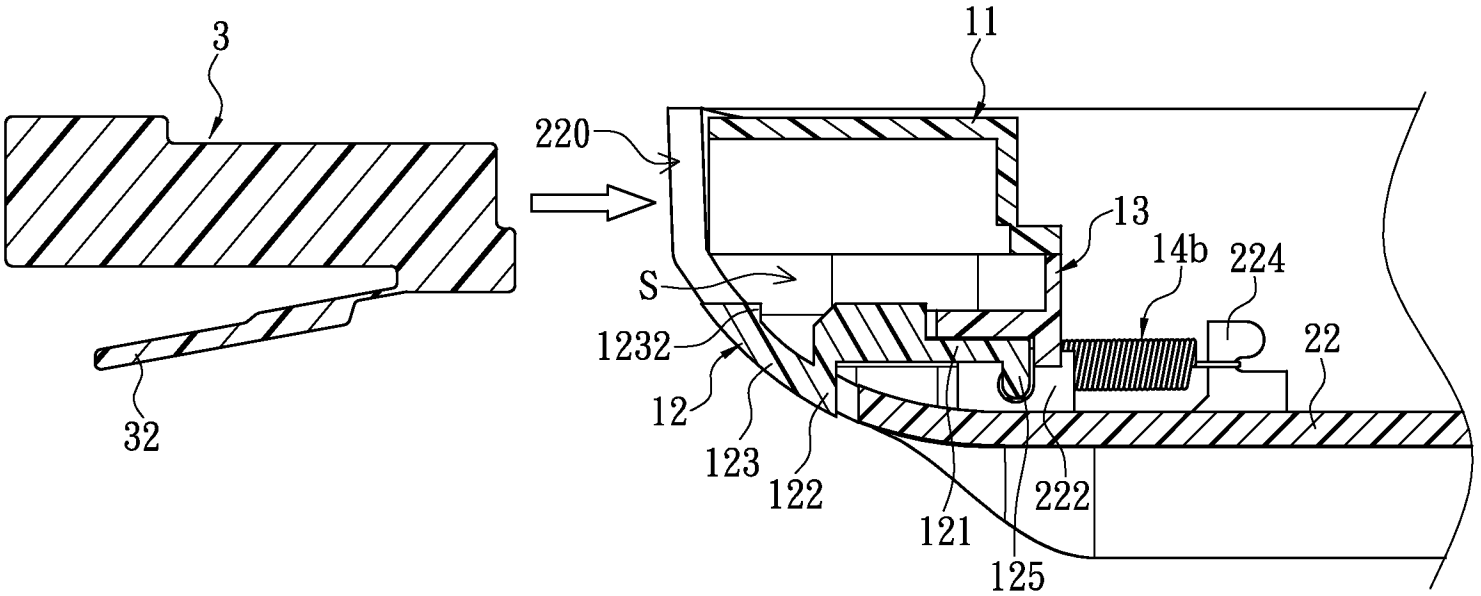
FIG. 10 shows a cross sectional diagram of the slim type electronic connector of FIG. 9 and an unplugged plug.
Figure 11:
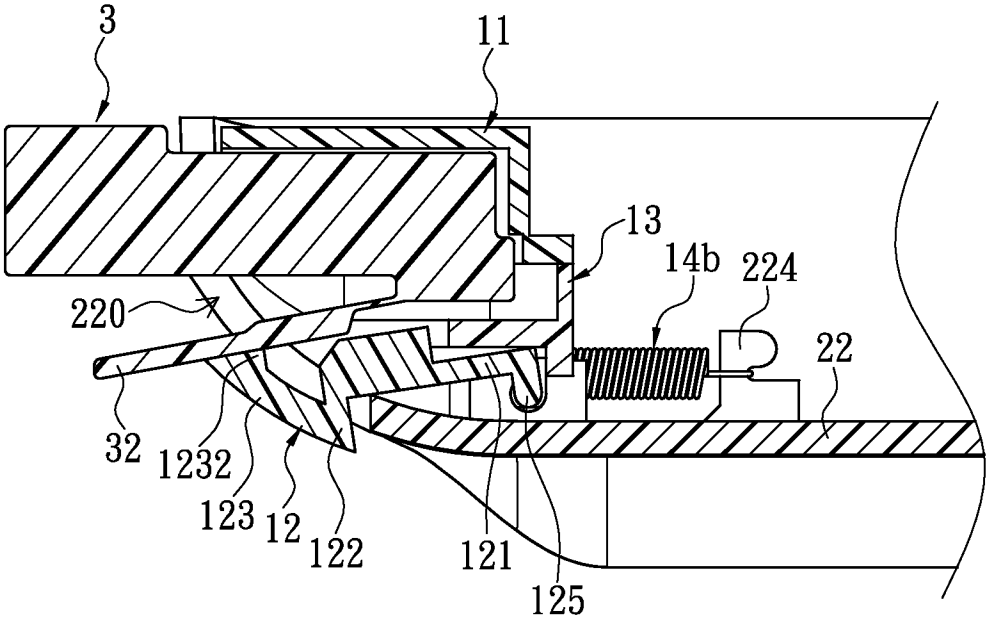
FIG. 11 shows a cross sectional diagram of the slim type electronic connector of FIG. 9 and a plugged plug.

FIG. 10 and FIG. 11 are side view cross sectional diagrams of a third embodiment of a slim type electronic connector of the present disclosure before and after accommodating the plug. When the covering lid 12 is open, the plug 3 can be inserted into the present disclosure, the sheltering portion 123 rotates outwards and moves away from the lower case 22 by some distance, and the hook portion 126 coincidentally moves outward and pulls on the stretch spring to store a spring force. When the plug 3 is inserted into the slim type electronic connector 1, the sheltering portion 123 is forced by the spring force of the stretch spring to press tightly upwards against the release arm 32 of the plug 3, in order to fix the plug 3 and prevent it from detaching.

Fourth Embodiment

Figure 12:
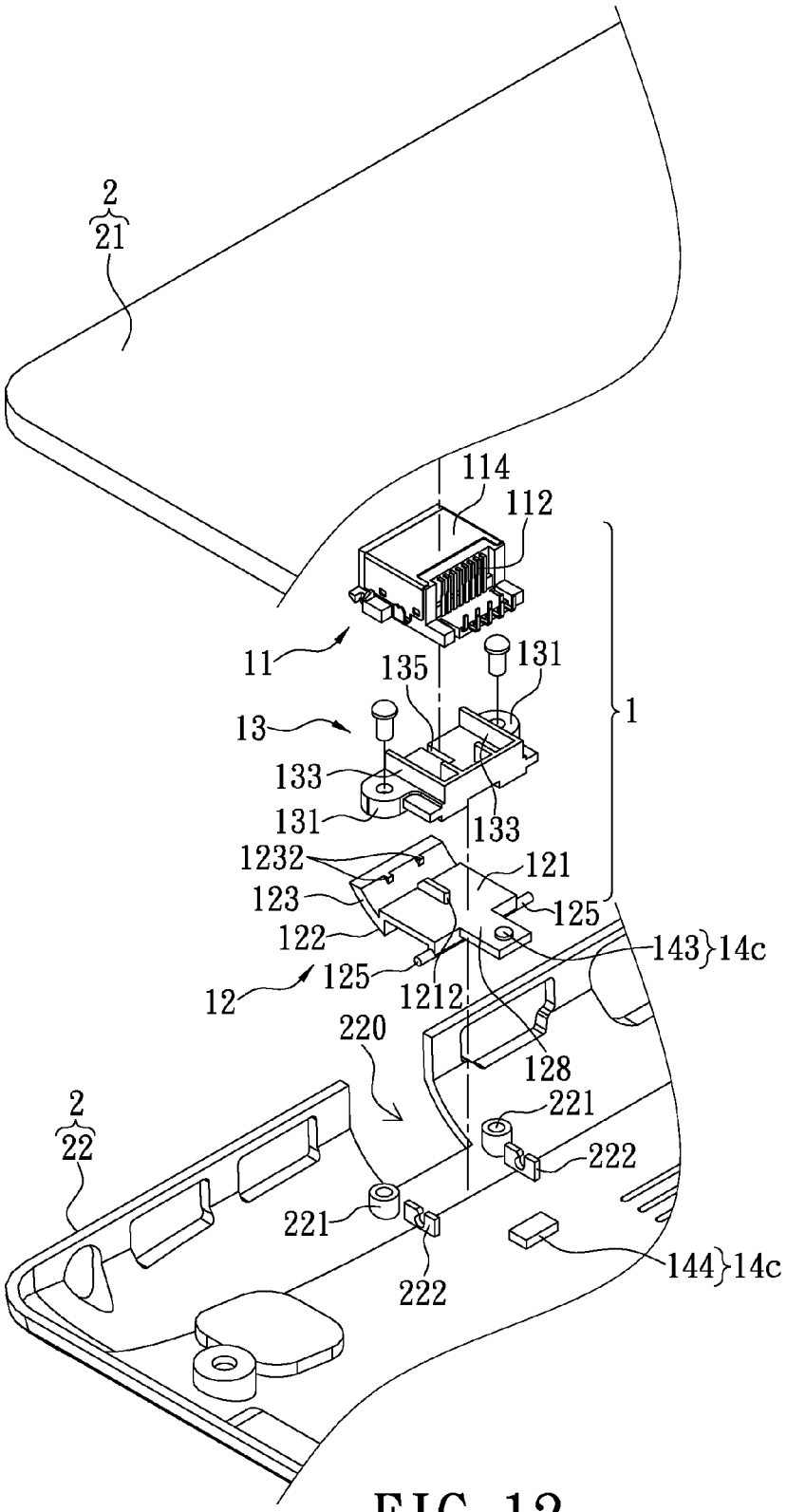
FIG. 12 shows a perspective exploded diagram of a fourth embodiment of a slim type electronic connector and an electronic device case of the present disclosure.

FIG. 12 is a perspective exploded diagram of a fourth embodiment of a slim type electronic connector and an electronic device case of the present disclosure. The present embodiment differs from the above embodiments in that the recovering element 14*c* of the present embodiment is a magnetic attachment module, for example including a magnetically attaching unit 143 and a magnetically attached unit 144. Obviously, the magnetically attaching unit 143 and the magnetically attached unit 144 can be interchanged, combination of which includes magnet and metal plate, magnet and magnet, etc. In the present embodiment, an arm portion 128 extends from the main body 121 away from the sheltering portion 123. The magnetic attachment module is disposed on the arm portion 128 and the electronic device case 2, as shown in FIG. 12 on the lower case 22.

Figure 13:
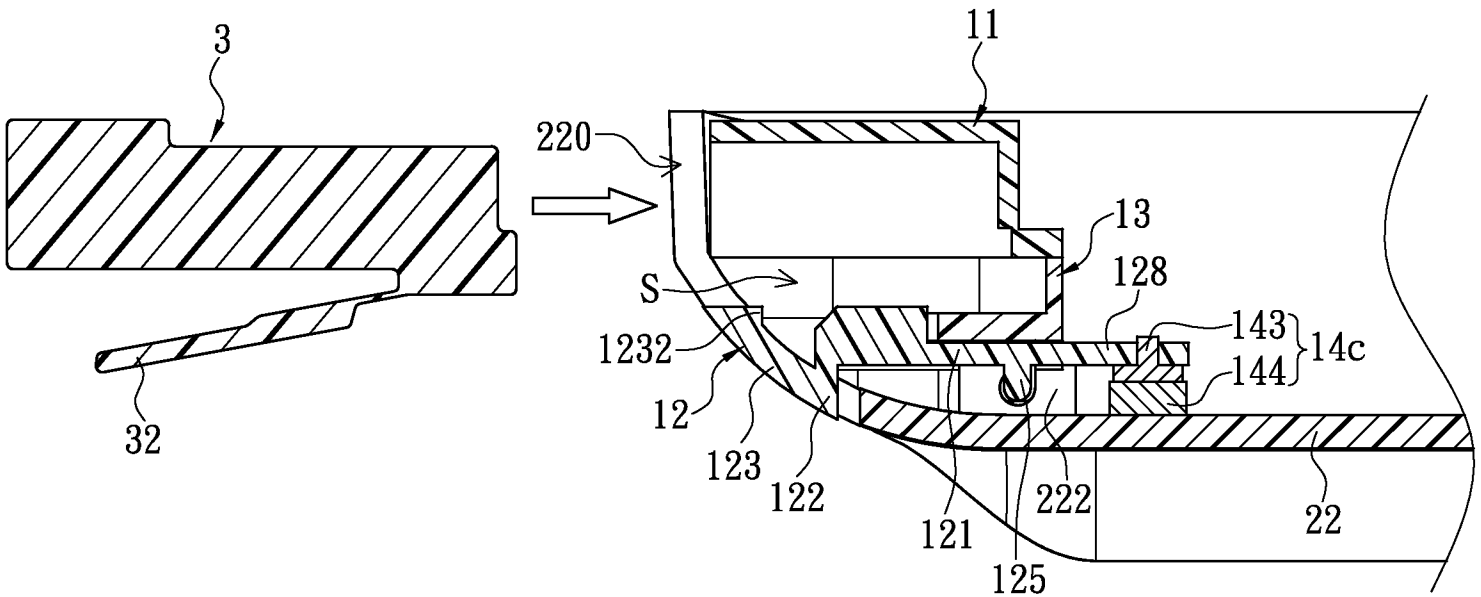
FIG. 13 shows a cross sectional diagram of the slim type electronic connector of FIG. 12 and an unplugged plug.
Figure 14:
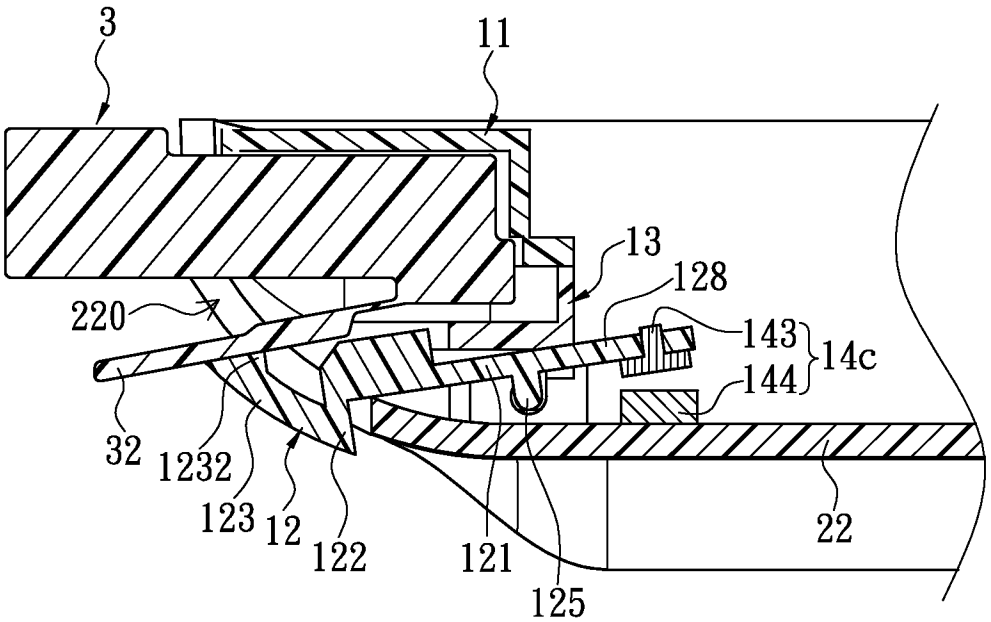
FIG. 14 shows a cross sectional diagram of the slim type electronic connector of FIG. 12 and a plugged plug.

FIG. 13 and FIG. 14 are cross sectional diagrams of the slim type electronic connector and the plug of FIG. 12 before and after accommodating the plug. The present embodiment employs the magnetically attaching unit 143 behind the covering lid 12 to attach to the magnetically attached unit 144 on the lower case 22, to keep the covering lid 12 in a covered position 22 during the normal state. When the user presses the sheltering portion 123 of the covering lid 12 downwards, the entrance portion 220 is exposed allowing the plug 3 to be inserted in. The arm portion 128 of the covering lid 12 moves upwards and away from the magnetically attached unit 144. The state of the inserted plug 3 is as shown in FIG. 14. When the user retrieves the plug 3, the magnetically attaching unit 143 fixed on the arm portion 128 and the magnetically attached unit 144 attract each other. Thus, the arm portion 128 moves downward driving the sheltering portion to move upwards and cover the input portion 220.

Fifth Embodiment

Figure 15:
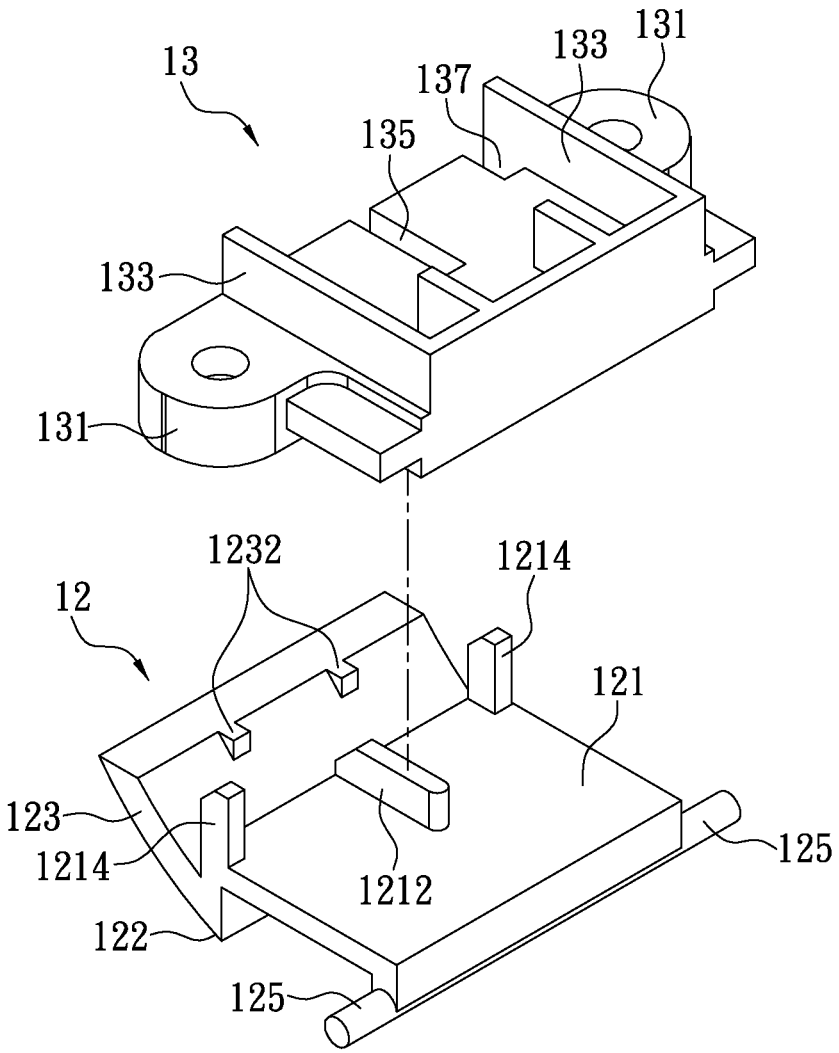
FIG. 15 shows a perspective exploded diagram of a fifth embodiment of a slim type electronic connector of the present disclosure.

FIG. 15 is a perspective exploded diagram of a fifth embodiment of the slim type connection unit of the present disclosure. The present embodiment only expresses the covering lid 12 and the holding seat 13. The other components can adopt the structure of the first embodiment. The present embodiment differs from FIG. 1 in that the covering lid 12 further includes a pair of top pushing pieces 1214 disposed on the top surface of the main body 121. The two top pushing pieces 1214 are positioned at the two sides of the guiding plate 1212 and are taller than the guiding plate 1212, for pressing against the underside of the inserted plug 3. Additionally, the holding seat 13 has a pair of side grooves 137 disposed on the two sides of the through groove 135. The two top pushing pieces 1214 pass through the two side grooves 137. In application, the covering lid 12 of the present embodiment can have at least one top pushing piece extending from the top surface of the main body 121 toward the holding seat 13. The holding seat 13 has at least one side groove corresponding to the top pushing piece.

Figure 16:
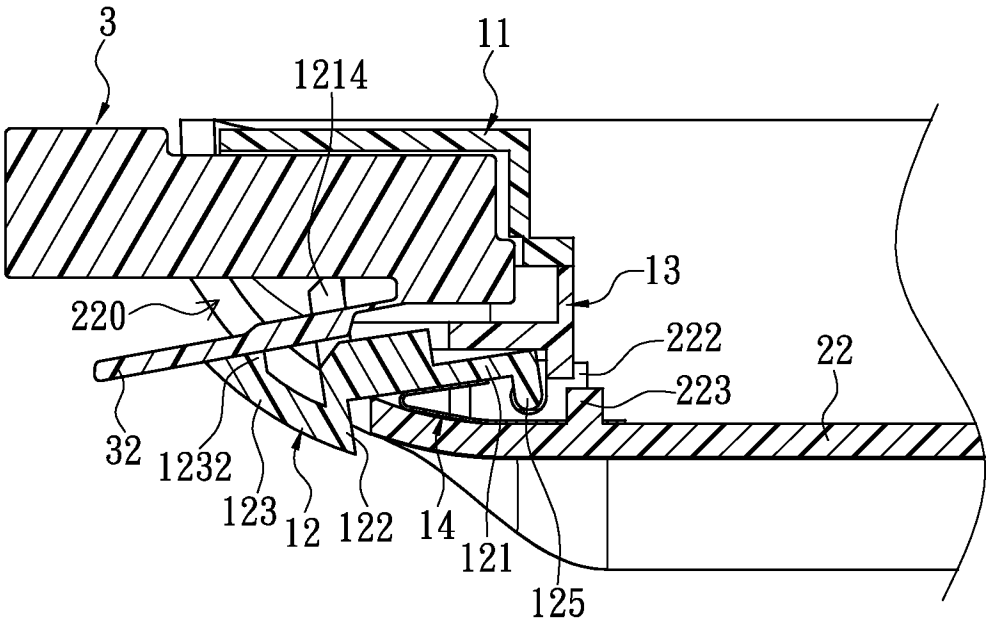
FIG. 16 shows a cross sectional diagram of the slim type electronic connector of FIG. 15 and an unplugged plug.
Figure 17:
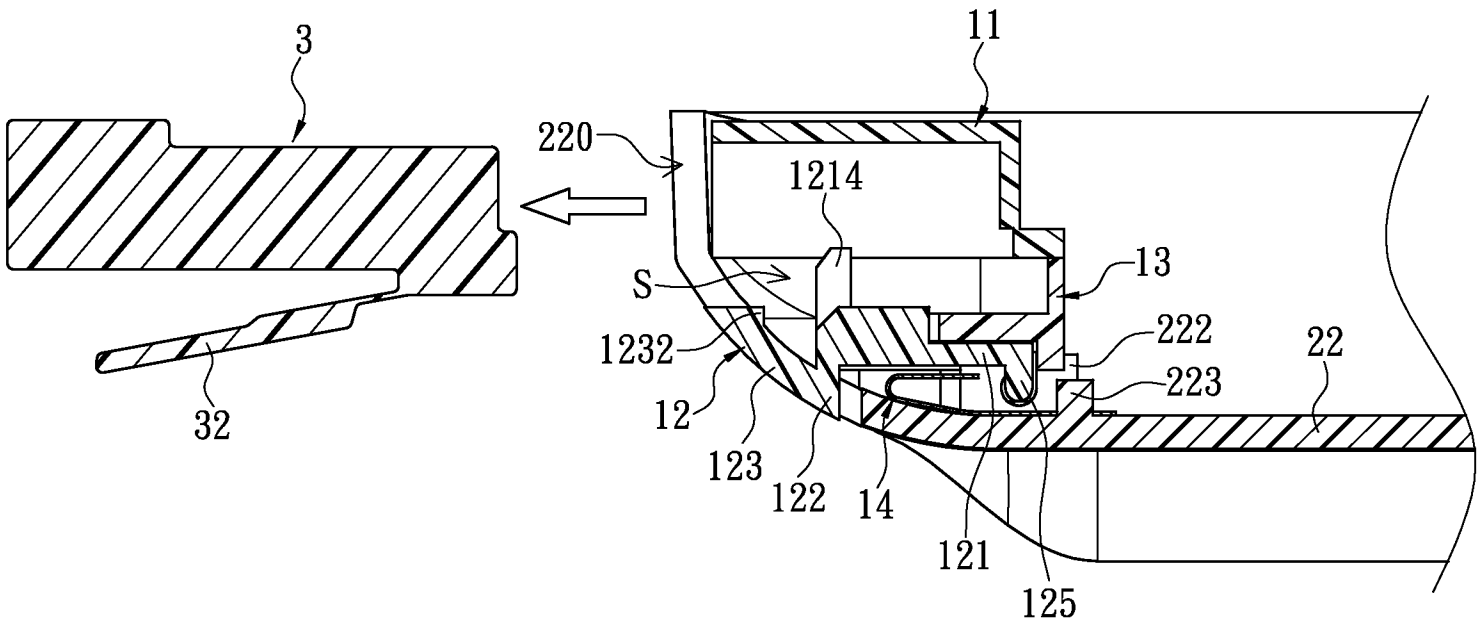
FIG. 17 shows a cross sectional diagram of the slim type electronic connector of FIG. 15 and a plugged plug.

Referring to FIG. 16 and FIG. 17, when the plug 3 is inserted into the slim type electronic connector, the guiding plate 1212 is positioned below the release arm 32, the two top pushing pieces 1214 are positioned at the two sides of the release arm 32 and abut the body of the plug 3, and the retaining blocks 1232 of the sheltering portion retain the release arm 32. Compared to the previous embodiment, the present embodiment has the additional advantage in that when the user unplugs the plug 3, he only needs to press the release arm 32 to make it leave the retaining blocks 1232 of the sheltering portion 123, without needing to also use the finger to press the sheltering portion 123 of the covering lid 12 downward. Thus, the user can unplug the plug 3. In the process of unplugging the plug 3 of the present embodiment, the top pushing pieces 1214 continue pushing against the underside of the plug 3. The covering lid 12 returns to the covered position only after the plug 3 has been withdrawn from the slim type electronic connector, as shown in FIG. 17. The two top pushing pieces 1214 spares the user from having to use a finger to overcome the restoring force provided by the recovering element 14 that engages the covering lid 12 to the release arm 32.

Therefore the slim type electronic connector and the electronic device having the same of the present disclosure have the following advantages:

1. The holding seat 13 is securely fixed on the lower case 22, in contrast to the typical structure pivotally connected to the upper case, thereby increasing the structural strength of the present disclosure.

2. The holding seat 13 of the present disclosure covers the pivot seat 222, thereby increasing the structural strength of the pivot seat 222, and prevents the covering lid 12 from damaging the pivot structure positioned between the covering lid 12 and the lower case 22 due to frequent tugging and plugging of the communication cables.

3. The present disclosure can further use the top pushing piece 1214 disposed on the top surface of the covering lid 12 to maintain the covering lid 12 at an opening position during the process of unplugging the plug 3 by continually pressing against the underside of the plug 3, sparing the user from having to press the covering lid 12 to the opening position with his finger. The user only needs to press the release arm 32 to successfully unplug plug 3.

The descriptions illustrated supra set forth simply the preferred embodiments of the present disclosure; however, the characteristics of the present disclosure are by no means restricted thereto. All changes, alternations, or modifications conveniently considered by those skilled in the art are deemed to be encompassed within the scope of the present disclosure delineated by the following claims.

What is claimed is:

1. A slim type electronic connector, for accommodating a plug within, comprising:

a half socket, which has multiple endpoints disposed thereon;

a covering lid, which has a main body, a sheltering portion extended from the main body, and at least one rotating axle formed at one end of the main body, wherein the at least one rotating axle is pivotally disposed on an electronic device case;

a holding seat disposed between the half socket and the covering lid, wherein the half socket and the holding seat form between them an inserting space for accommodating plugs, when the covering lid rotates along the rotating axles to a covered position, the sheltering portion of the covering lid extends beyond a front edge of the holding seat, and when the covering lid rotates along the rotating axles to an opening position, the sheltering portion moves away from the front edge of the holding seat to expose the inserting space; and a recovering element, for providing a force on the sheltering portion of the covering lid to press against the holding seat;

wherein when the plug is inserted between the half socket and the holding seat, the recovering element pushes the sheltering portion to engage the plug for preventing the plug from moving outside.

2. The slim type electronic connector according to claim 1, wherein the holding seat abuts the half socket, and the length of the half socket is larger than the length of the holding seat.

3. The slim type electronic connector according to claim 1, wherein the position of the holding seat corresponds to the main body, two sides of the holding seat each have a fixing portion, and the fixing portions are fixed on the electronic device case.

4. The slim type electronic connector according to claim 1, wherein the holding seat has multiple lateral sides facing the half socket for guiding the plug.

5. The slim type electronic connector according to claim 1, wherein the holding seat forms a through groove facing outward, the main body forms a guiding plate facing toward the holding seat, and the guiding plate is movably positioned in the through groove.

6. The slim type electronic connector according to claim 1, wherein a pair of retaining blocks protrudes on the inner surface of the sheltering portion towards the holding seat, for preventing the plug from detaching.

7. The slim type electronic connector according to claim 1, wherein the number of rotating axle is two, and the two rotating axles are disposed on the end of the main body further away from the sheltering portion and extend outward from the two sides of the main body.

8. The slim type electronic connector according to claim 7, wherein the recovering element is a stretch spring, the two rotating axles each has a hook portion protruding toward the holding seat, one end of the stretch spring is connected to the hook portion, and another end of the stretch spring is fixed to the electronic device case.

9. The slim type electronic connector according to claim 7, wherein the recovering element is a coil spring, and the coil spring is disposed between the main body and the electronic device 2.

10. The slim type electronic connector according to claim 7, wherein the recovering element is a spring plate, and the spring plate is disposed between the main body and the electronic device case.

11. The slim type electronic connector according to claim 7, wherein the recovering element comprises a magnetic attachment module, an arm portion extends from the main body in the direction away from the sheltering portion, and the magnetic attachment module is respectively disposed on the arm portion and the electronic device case.

12. The slim type electronic connector according to claim 1, wherein the covering lid further has at least one top pushing piece extending from the top surface of the main body toward the holding seat, the holding seat has at least one side groove corresponding to the top pushing piece, the top pushing piece passes through the side groove; when the plug is in an inserted state, the top pushing piece abuts the plug and is positioned on one side of a release arm of the plug.

13. An electronic device having a slim type electronic connector, comprising:

an upper case;

a lower case, having an entrance portion for a plug to be inserted into, and at least one pivot seat; and a slim type electronic connector, comprising:

a half socket, positioned under the upper case and having multiple endpoints;

a covering lid, which has a main body, a sheltering portion extended from the main body for sheltering the entrance portion, and at least one rotating axle formed at one end of the main body, wherein the at least one rotating axle is pivotally disposed correspondingly to at least one pivot seat;

a holding seat, disposed between the half socket and the covering lid, wherein an inserting space is formed between the half socket and the holding seat, and the sheltering portion extends beyond a front edge of the holding seat; and a recovering element, for providing a force on the sheltering portion of the covering lid to press against the holding seat;

wherein when the plug is inserted between the half socket and the holding seat, the recovering element pushes the sheltering portion to engage the plug to prevent the plug from moving outside.

14. The electronic device having a slim type electronic connector according to claim 13, wherein the holding seat abuts the half socket, and the length of the half socket is larger than the length of the holding seat.

15. The electronic device having a slim type electronic connector according to claim 13, wherein the position of the holding seat corresponds to the main body, each of the two sides of the holding seat has a fixing portion, the lower case has a pair of columns, and the fixing portions are fixed to the columns.

16. The electronic device having a slim type electronic connector according to claim 13, wherein the number of the rotating axle is two, the two rotating axles are disposed on an end of the main body further away from the sheltering portion and extends outward from the two sides of the main body, the lower case has a pair of pivot seats, and the two rotating axles are pivotally disposed on the two pivot seats.

17. The electronic device having a slim type electronic connector according to claim 16, wherein the recovering element is a stretch spring, the two rotating axles each have a hook portion protruding toward the holding seat, an end of the stretch spring is connected to the hook portion, and another end of the stretch spring is fixed to the lower case of the electronic device.

18. The electronic device having a slim type electronic connector according to claim 16, wherein the recovering element comprises a magnetic attachment module, an arm portion extends on the main body away from the sheltering portion, and the magnetic attachment module is respectively disposed on the arm portion and the lower case.

19. The electronic device having a slim type electronic connector according to claim 13, wherein the sheltering portion of the covering lid extends toward the lower case in an arc shape, and correspond to the contour of the lower case.

20. The electronic device having a slim type electronic connector according to claim 13, wherein the covering lid further has at least one top pushing piece extending from the top surface of the main body toward the holding seat, the holding seat has at least one side groove corresponding to the top pushing piece, the top pushing piece passes through the side groove; when the plug is in an inserted state, the top pushing piece abuts the plug and is positioned on a side of a release arm of the plug.

* * * * *